US005472104A

United States Patent [19]

Domsgen

[11] Patent Number: 5,472,104

[45] Date of Patent: Dec. 5, 1995

[54] CENTRAL BUFFER COUPLING FOR RAIL-BORNE VEHICLES PIVOTABLE BETWEEN AN OPERATIVE AND INOPERATIVE POSITION

[75] Inventor: Matthias Domsgen, Mozartstr., Germany

[73] Assignee: Scharfenbergkupplung GmbH, Salzgitter, Germany

[21] Appl. No.: 296,733

[22] Filed: Aug. 26, 1994

[30] Foreign Application Priority Data

Aug. 27, 1993 [DE] Germany ..... 43 28 811.1

[51] Int. Cl.[6] ..... B61G 7/00

[52] U.S. Cl. ..... 213/4; 213/18; 213/74; 280/491.3

[58] Field of Search ..... 213/4, 5, 6, 12, 213/16, 18, 19, 20, 21, 74, 104; 280/491.1, 491.3

[56] References Cited

U.S. PATENT DOCUMENTS

| | | | |
|---|---|---|---|
| 709,338 | 9/1902 | Lennon | 213/4 |
| 1,132,575 | 3/1915 | Giberson | 213/6 |
| 2,212,646 | 8/1940 | Nekola | 213/4 |
| 4,049,129 | 9/1977 | Bergs | 213/4 |
| 4,109,930 | 8/1978 | Pilhall | 280/491.3 |
| 4,485,931 | 12/1984 | Forster et al. | 213/4 |

FOREIGN PATENT DOCUMENTS

| | | | |
|---|---|---|---|
| 2227739 | 11/1974 | France | 280/491.3 |
| 3213697 | 10/1983 | Germany . | |

*Primary Examiner*—Robert J. Oberleitner
*Assistant Examiner*—S. Joseph Morano
*Attorney, Agent, or Firm*—McGlew and Tuttle

[57] ABSTRACT

The present invention pertains to a central buffer coupling for rail-borne vehicles with a two-part coupling shaft formed by a front shaft part (2) carrying the coupling shaft (1) and by a rear shaft part (3) hinged horizontally pivotably to the chassis of the rail-borne vehicle, wherein the two shaft parts (2 and 3) of the two-part coupling shaft are connected to one another by a vertical connecting pin (5). A locking bar (7), which is displaceable in the longitudinal direction to a limited extent in the coupling shaft, is provided as the fixing device, and the said locking bar can be displaced, in the mutually extended position of the two shaft parts (2 and 3), by the force of a spring (13), into a locked position, in which the locking bar (7) associated with one of the shaft parts (2 or 3) engages the vertical groove (6) associated with the other shaft part (3 or 2) to make the coupling shaft rigid.

10 Claims, 3 Drawing Sheets

CENTRAL BUFFER COUPLING FOR RAIL-BORNE VEHICLES PIVOTABLE BETWEEN AN OPERATIVE AND INOPERATIVE POSITION

FIELD OF THE INVENTION

The present invention pertains to a central buffer coupling for railborne vehicles including a two-part coupling shaft formed by a front shaft part carrying the coupling head of the central buffer coupling and by a rear shaft part horizontally pivotably hinged to the chassis of the rail borne vehicle.

BACKGROUND OF THE INVENTION

In prior-art central buffer couplings, the coupling head projects beyond the vehicle profile on the front side. Central buffer couplings, whose coupling head can be pivoted into the vehicle profile when not in use, can be considered for use especially for rail-borne vehicles which do not travel on lines of their own, e.g., streetcars, in order to avoid a hazard for other road users due to a coupling head projecting beyond the railborne vehicle on the front side.

U.S. Pat. No. 4,049,129 discloses a central buffer coupling of the type described in the introduction, in which the fixing device has a vertical locking pin, which is fastened to the rear shaft part, passes through an arc-shaped, slot-like opening provided on the front shaft part and is concentric with the axis of the connecting pin, and on which a locking ring having an outer cone is axially displaceable by means of an adjusting device, which can be operated manually.

At its two ends, the slot-like opening has a conical locking depression each, and the locking ring can be pushed by means of the adjusting device into one of the locking depressions in the extended position of the two shaft parts, and into the other locking depression in the mutually pivoted position of the shaft parts.

To release the fixing device, the locking ring can be lifted out of the locking depression in question by the adjusting device.

The fixing device has a complicated design in this prior-art embodiment, because not only are the locking pin, the slot-like opening with the locking depressions, as well as the locking ring necessary, but the adjusting device for the locking ring must also be made of a plurality of individual parts, because it must bring about the axial displacement of the locking ring on the locking pin, on the one hand, and, on the other hand, it must secure the locking ring in its position corresponding to the mutually extended position of the two shaft parts.

DE 32,13,697 A1 discloses a central buffer coupling, in which a sliding sleeve, which is mounted on the coupling shaft in such a way that it is able to be displaced to a limited extent in the longitudinal direction of the coupling shaft, is provided as the fixing device, and the said sliding sleeve is displaceable, by the force of the springs, in the mutually extended position of the two shaft parts, into a locked position, in which the sliding sleeve overlaps both shaft parts to make the coupling shaft rigid, and a cam, connected nonrotatably to the connecting pin, is arranged at each end of the connecting pin, and the said cam has a cam surface, which is eccentric with the axis of the connecting pin and cooperates with the front surface of the sliding sleeve facing it, and the said cams form a stop for the sliding sleeve in their locked position, and by pivoting the cams, the sliding sleeve can be displaced against the force of the springs into an unlocked position, which makes it possible to pivot the front shaft part, and in which the sliding sleeve can be fixed.

SUMMARY AND OBJECTS OF THE INVENTION

The primary object of the present invention is to design a central buffer coupling of the type described in the introduction as simply as possible in terms of the design of the fixing device at a high level of functional reliability.

According to the invention, a central buffer coupling is provided for rail-borne vehicles with a two-part coupling shaft formed by a front shaft part, carrying the coupling head of the central buffer coupling, and by a rear shaft part, horizontally pivotably hinged to the chassis of the rail-borne vehicle. The two shaft parts of the two-part coupling shaft are connected to one another by a vehicle connecting pin. The shaft parts can be pivoted in relation to one another around the connecting pin. One shaft part includes a forked portion projecting over the other shaft part, in the manner of a fork head, with upper and lower fork legs provided in a hinge area. The two shaft parts can be fixed in relation to one another to form a rigid coupling shaft, in their mutually extended position, in which the coupling head is located outside the vehicle profile, and the front shaft can be pivoted, after the fixing device has been released, into a position in which the coupling head is located within the vehicle profile. The structure includes a locking bar which is limitedly displaceable in a longitudinal direction of the coupling shaft and is provided as the fixing device. The locking bar can be displaced into a locked position by the force of a spring in the mutually extended position of the two shafts, in which locked position of the locking bar associated with one of the shaft parts engages a vertical groove associated with the other shaft part to make the coupling shaft rigid. The locking bar is arranged in the vertical central longitudinal plane and is vertically supported on an upper as well as a lower fork leg of the fork head via a support plate and via bolts. The locking bar is displaceable against the force of the spring within a vertical groove provided in one of the front shaft part and a rear shaft part. The support plates are pivotably fastened via another bolt on one side of the vertical central longitudinal plane to the respective upper and lower fork legs. The bolts are guided in a respective elongated hole in the support plates.

The groove is preferably provided with a receiving opening expanding in a forward direction. The front shaft part is preferably pivotable by approximately 150° in relation to the rear shaft part. The support plates are preferably pivotable by approximately 60°. The fixing device with the locking bar and the groove is preferably arranged between the connecting pin and the coupling head. The rear shaft part has on one side of the vertical central longitudinal plane, a ramp, with which the locking bar comes into contact during the pivoting from the pivoted position into the extended position. This ramp also displaces the locking bar to the rear in the direction of the pressure piece during the further pivoting against the force of the spring. A cover may be provided which covers the groove of the rear shaft part in the pivoted position and is fastened to the front shaft part. The fixing device with the locking bar and the groove is arranged between the connecting pin for the two shaft parts and the hinge connection of the rear shaft part.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
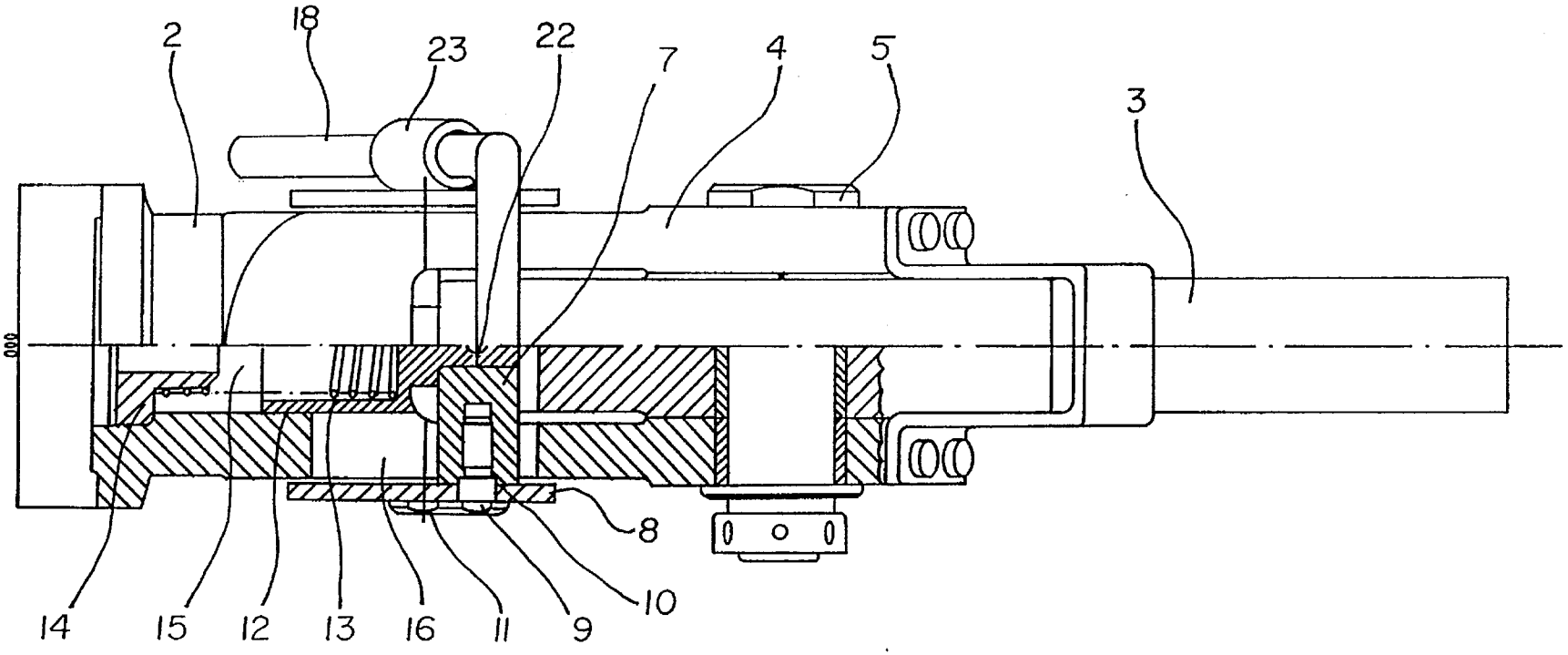
FIG. 1 is a partially cutaway side view of the connection area of the two shaft parts of a central buffer coupling according to the present invention.

The coupling shaft of the central buffer coupling comprises a front shaft part 2 carrying the coupling head 1 and a rear shaft part 3 hinged horizontally pivotably to the chassis of the rail-borne vehicle.

The front shaft part 2 is designed at the free end as a fork head 4 with upper and lower fork legs, wherein the fork legs accommodate the rear shaft part 3 between them. The shaft parts 2 and 3 are connected to one another by means of a connecting pin 5 through the fork head 4 and the shaft part 3 such that the front shaft part 2 is horizontally pivotable in relation to the rear shaft part 3.

A vertical groove 6, with which a locking bar 7 associated with the front shaft part 2 can be engaged, is provided at the end of the rear shaft part 3 projecting over the connecting pin 5.

The locking bar 7 is arranged in the vertical central longitudinal plane and is supported vertically, via a support plate 8 each, from the outside, on the upper and lower fork heads, via bolt 9 or via the bolt 9 and the bushing 10.

The support plates 8 are pivotably fastened to the upper and lower fork legs via a fastening element (bolt 11) on one side of the vertical central longitudinal plane of the coupling shaft. The pivoting angle is 60° in the example.

The locking bar 7 is connected by means of the fastening element 22 to a sleeve 12, which is guided in the front shaft part 2 and in which a compression spring 13 is arranged, which is supported on the bottom of a spring chamber 15 located in the front shaft part 2 via a pressure piece 14 and is guided by the sleeve 12 within the fork head 4 in the front shaft part 2. In the area of the horizontal range of displacement of the locking bar 7, the front shaft part 2 has a vertical groove 16, in which the locking bar 7 can be pushed into the groove 6 of the rear shaft part 3 and can be pushed out of the groove 6 in a limitedly displaceable manner for locking and unlocking.

The bolts 9 and the bushings 10 are guided in an elongated hole 17 in the support plates 8.

A sleeve 23, into which a U-shaped fastening element (grip 18) is pushed with its free legs, is fastened to the support plates 8. The grip can be displaced within the sleeves 23; it is secured against falling out by means of a securing element 19.

The groove 6 is provided with a receiving opening expanding in the forward direction, which can be engaged, without clearance, by the locking bar 7, which correspondingly tapers in the forward direction. In conjunction with the spring tension of the locking bar 7, clearance-free locking of the two shaft parts 2 and 3 against each other is thus achieved.

On the side of the vertical central length, toward which the front shaft part 2 can be pivoted, the rear shaft part 3 has a ramp 20, with which the locking bar 7 comes into contact during pivoting out of the pivoted position into the extended position, and on which the locking bar 7 is displaced to the rear, sliding along, in the direction of the pressure piece 14, during further pivoting, against the force of the compression spring 14. If the front and rear shaft parts 2 and 3 are in the extended position, the locking bar 7, tensioned by the tensioning force of the compression spring 13, jumps into the groove 6 of the rear shaft part 3 and locks the extended position.

The fixing device is released by rotating the grip 18. The rotary movement of the grip 18 and of the support plates 8 connected thereto is converted via the elongated holes 17 into a rectilinear movement of the locking bar 7 within the vertical groove 16.

When the locking bar 7 is disengaged from the groove 6, the front shaft part 2 is pivotable around the connecting pin 5. A cover 21, which covers the groove 6 of the rear shaft part 3 in the pivoted position and protects it from dirt, is arranged on the front shaft part 2.

Pivoting of the front shaft part 2 by 150° relative to the rear shaft part 3 is provided in the exemplary embodiment.

Figure 3:
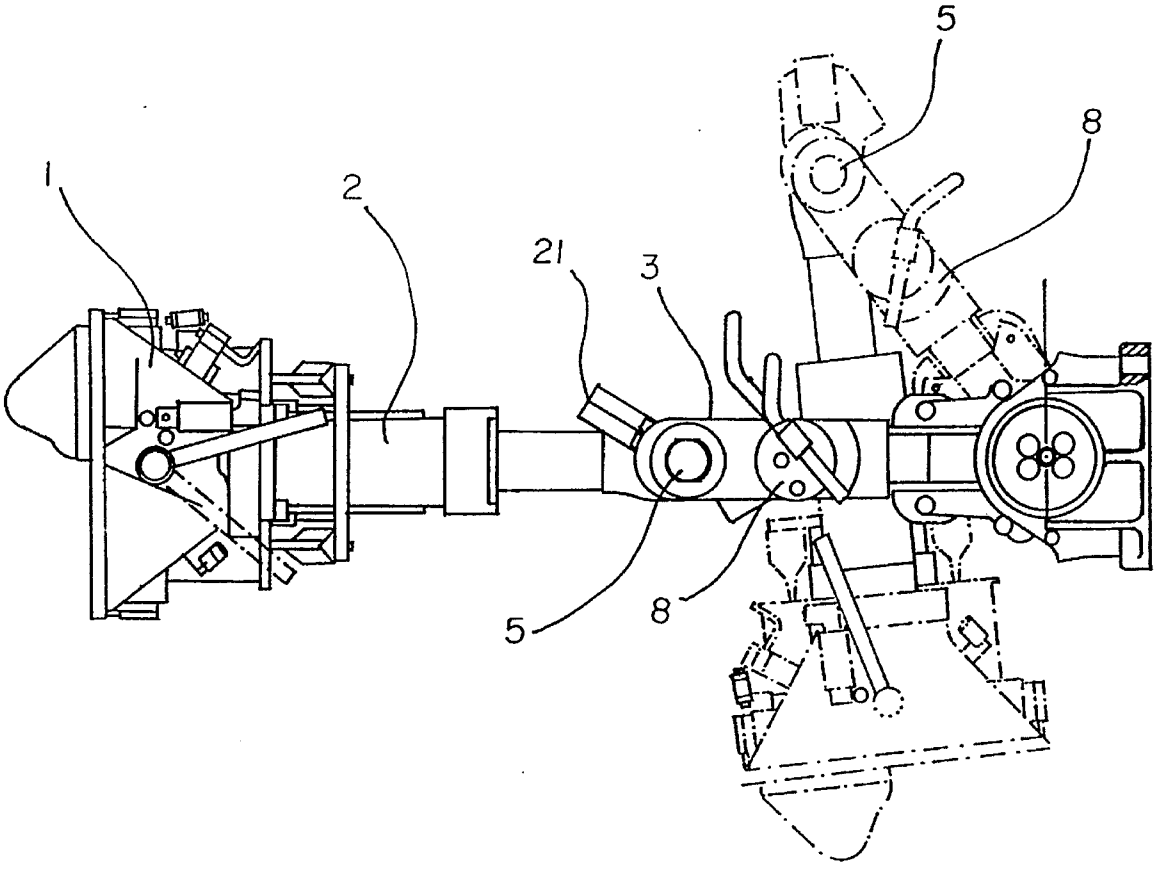
FIG. 3 is a second embodiment of the present invention with hinged coupling head and support on the rail-borne vehicle in a top view.

Since the rear shaft part 3 can be pivoted at the same time in the opposite direction in its hinge connection on the chassis, the entire central buffer coupling, including the coupling head 1, can be pivoted in within the front-side clearance. The front shaft part 2 can be pivoted in via the parallel position to the front side (FIG. 3).

Figure 2:
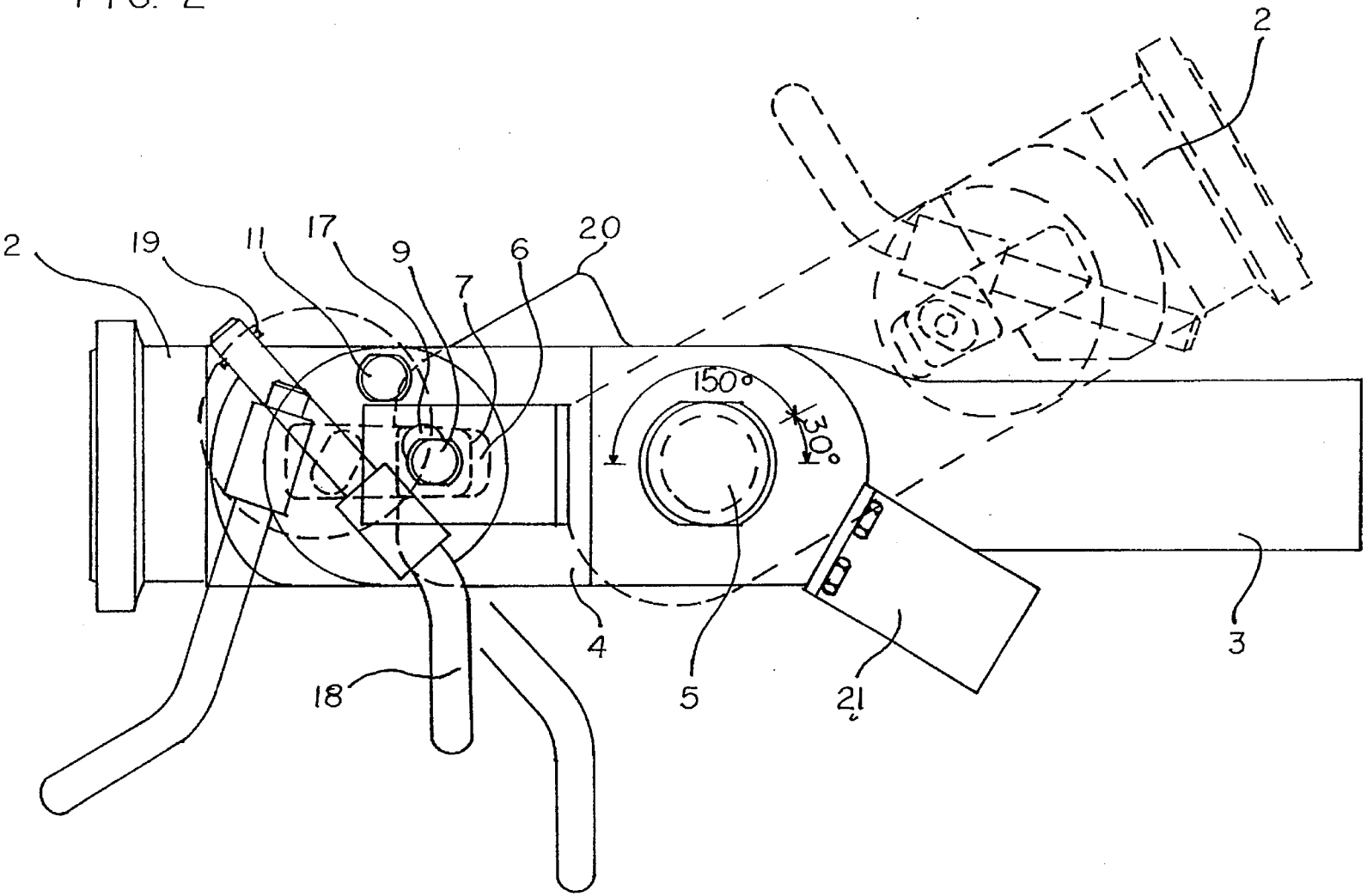
FIG. 2 is a top view of the connection area according to FIG. 1 in the locked position of the fixing device for the two shaft parts, as well as in the pivoted position (dash-dotted line)

In the first exemplary embodiment (FIGS. 1 and 2), the fixing device with the locking bar 7 and the groove 6 is arranged between the connecting pin 5 and the coupling head 1.

In the second exemplary embodiment (FIG. 3), the fixing device with the locking bar 7 and the groove 6 is arranged between the connecting pin 5 for the shaft parts 2 and 3 and the hinge connection of the rear shaft part 3 on the rail-borne vehicle.

In this arrangement, the essential elements of the fixing device, especially the spring-tensioned locking bar 7, are arranged at the free end of the rear shaft part 3; in contrast, the correspondingly designed groove 6 is at the end of the front shaft part 2, which projects over the connecting pin 5. Thus, the rear shaft part 3 at the free end is designed as a fork head 4 in this solution, and it accommodates the front shaft part 2 between the fork legs. The support plates 8, the sleeve 12, the compression spring 13, the pressure piece 14, the spring chamber 15, the ramp 20, the cover 21, as well as the vertical groove 16 are thus associated with the rear shaft part 3 in this case.

Arrangement of the fixing device according to the second exemplary embodiment is advantageous when sufficient space for installation is unavailable on the shaft part 2 because the front shaft part 2 is to be designed as a short shaft part.

While specific embodiments of the invention have been shown and described in detail to illustrate the application of the principles of the invention, it will be understood that the invention may be embodied otherwise without departing from such principles.

What is claimed is:

1. Central buffer coupling for rail-borne vehicles, comprising:

a front shaft part carrying a coupling head of the central buffer coupling;

a rear shaft part horizontally pivotably hinged to the chassis of the rail-borne vehicle;

a vertical connecting pin connecting said front shaft part to said rear shaft part, said front shaft part and said rear shaft part being pivoted in relation to one another around said connecting pin;

one of said front shaft and said rear shaft part including a fork portion extending over the other of said front shaft part and said rear shaft part to form a fork head with upper and lower fork legs in a hinge area;

fixing means for fixing said front shaft part and said rear shaft part in an extended position, in which said coupling head is located outside of a vehicle profile and releasing said shaft parts for pivoting said front shaft part into a position in which said coupling head is located within the vehicle profile, said fixing means including a locking bar and a spring, said locking bar being limitedly displaceable in a longitudinal direction and being displaced into a locked position by force of said spring to maintain said extended position, said locking bar being associated with one of said front shaft part and said rear shaft part and engaging a vertical groove associated with the other of said front shaft part and said rear shaft part in said extended position, said locking bar being arranged in a vertical central longitudinal plane and being vertically supported by said upper fork leg and by said lower fork leg via a support plate and via bolts, said locking bar being displaceable against a force of said spring within said vertical groove, said support plates being pivotably fastened via an additional bolt on one side of said vertical central longitudinal plane to a corresponding one of said upper fork legs and said lower fork legs, said bolts being guided in an elongated hole in said support plates; and an operating element fastened to said support plates for moving said locking bar between a locked and unlocked position.

2. Central buffer coupling according to claim 1, wherein said groove is provided with a receiving opening expanding in a forward direction of the central buffer.

3. A central buffer coupling according to claim 1, wherein said front shaft part is pivotable by substantially 150° in relation to said rear shaft part.

4. Central buffer coupling according to claim 1, wherein said support plates are pivotable by substantially 60°.

5. Central buffer according to claim 1, wherein said fixing means is arranged between said connecting pin and said coupling head.

6. Central buffer coupling according to claim 5, wherein said rear shaft part has, on one side of a vertical central longitudinal plane, a ramp, with which said locking bar comes into contact during pivoting movement from said pivoted position to said extended position, said locking bar being displaced on said ramp to the rear during further pivoting movement, against the force of the spring.

7. Central buffer coupling according to claim 5, further comprising a cover which covers said groove of said rear shaft part in said pivoted position, said cover being fastened to said front shaft part.

8. Central buffer coupling according to claim 1, wherein said fixing means is arranged between said connecting pin and a rear connection of said rear shaft part.

9. Central buffer coupling according to claim 8, wherein said front shaft part has a ramp on one side of a vertical central longitudinal plane, said locking bar coming into contact with said ramp during pivoting from said extended position, said locking bar being displaced on said ramp during further pivoting against a force of said spring to the rear.

10. Central buffer coupling according to claim 9, further comprising a cover for covering said groove of said front shaft part in said pivoted position, said cover being fastened to said rear shaft part.

* * * * *